US011745244B2

(12) United States Patent
Caporusso et al.

(10) Patent No.: US 11,745,244 B2
(45) Date of Patent: Sep. 5, 2023

(54) MACHINE FOR BENDING AN ELONGATED WORKPIECE WITHOUT WRINKLING

(71) Applicant: CML INTERNATIONAL S.P.A., Piedimonte San Germano (IT)

(72) Inventors: Alessandro Caporusso, Piedimonte San Germano (IT); Werner Davide D'Agostino, Villa Latina (IT)

(73) Assignee: CML INTERNATIONAL S.P.A., Piedimonte San Germano (IT)

( * ) Notice: Subject to any disclaimer, the term of this patent is extended or adjusted under 35 U.S.C. 154(b) by 334 days.

(21) Appl. No.: 17/294,336

(22) PCT Filed: Nov. 13, 2019

(86) PCT No.: PCT/IB2019/059730
§ 371 (c)(1),
(2) Date: May 14, 2021

(87) PCT Pub. No.: WO2020/100048
PCT Pub. Date: May 22, 2020

(65) Prior Publication Data

US 2021/0402451 A1 Dec. 30, 2021

(30) Foreign Application Priority Data

Nov. 16, 2018 (IT) ..... 102018000010409

(51) Int. Cl.

| | |
|---|---|
| ***B21D 7/02*** | (2006.01) |
| ***B21D 7/024*** | (2006.01) |
| ***B21D 7/03*** | (2006.01) |
| ***B21D 37/02*** | (2006.01) |

(52) U.S. Cl.
CPC ..... *B21D 7/024* (2013.01); *B21D 7/03* (2013.01); *B21D 37/02* (2013.01)

(58) Field of Classification Search
CPC . B21D 7/02; B21D 7/024; B21D 7/03; B21D 7/022; B21D 37/02
See application file for complete search history.

(56) References Cited

U.S. PATENT DOCUMENTS

2008/0110223 A1* 5/2008 Zuber ..... B21D 7/024 72/309
2016/0175909 A1 6/2016 Nozu

FOREIGN PATENT DOCUMENTS

| | | | |
|---|---|---|---|
| EP | 1226887 | A1 | 7/2002 |
| EP | 1700647 | A1 | 9/2006 |
| EP | 2799158 | A1 | 11/2014 |

(Continued)

*Primary Examiner* — Debra M Sullivan
(74) *Attorney, Agent, or Firm* — Browdy and Neimark, PLLC

(57) ABSTRACT

A machine for bending an elongated workpiece without wrinkling has a roller-like bending die (2) with a vice (3) adapted to retain one end of the elongated workpiece (P) to be bent. The roller-like bending die (2), being provided with a central hole (5) and a groove profile (6) and rotatable about a rotation axis (y), bears, centrally and coaxially in its groove profile (6), a plate element (18) oscillating with respect to the bending die (2) around a rotation axis (y) thereof. The plate element (18) having a peripheral edge (19) which continues the groove profile (6) of the bending die (2) consists of at least two pieces (20, 21) which are adapted to be connected to one another to surround the bending die (2).

9 Claims, 4 Drawing Sheets

(56) References Cited

FOREIGN PATENT DOCUMENTS

| | | | |
|---|---|---|---|
| JP | 2017087220 A | * | 5/2017 |
| JP | 2017087220 A | | 5/2017 |

* cited by examiner

Fig. 5
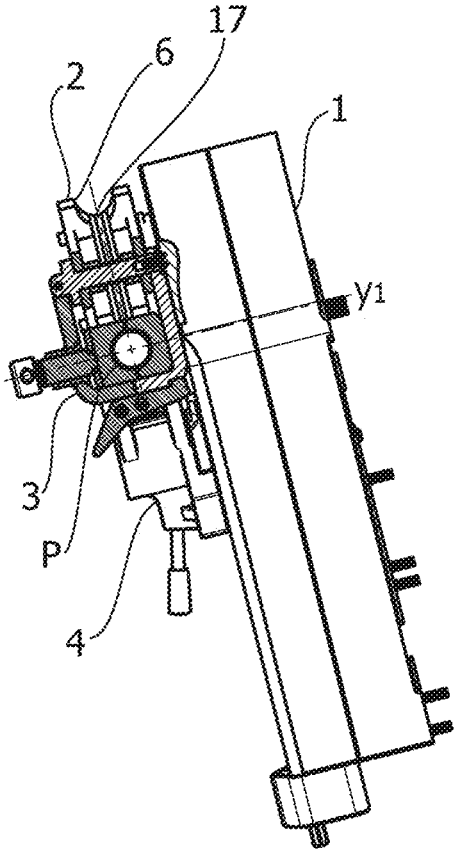
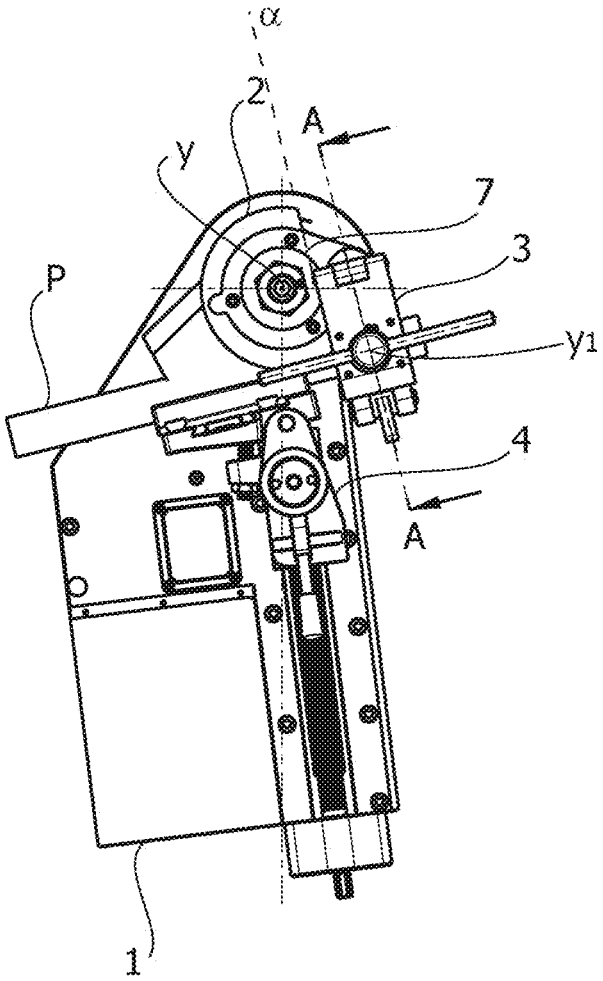
Fig. 3

MACHINE FOR BENDING AN ELONGATED WORKPIECE WITHOUT WRINKLING

TECHNICAL FIELD

The present invention relates to a machine for bending an elongated workpiece without wrinkling.

BACKGROUND ART

Normally, the formation of wrinkles in the tubular wall of an elongated piece, subjected to high pressure stresses in a bending operation, is avoided by means of an anti-wrinkle tool positioned near the bending die. The anti-wrinkle tool works as long as it is positioned correctly with respect to the bending die. The presence of a non-uniformity or even small gap between the bending die and the anti-wrinkle tool is sufficient to create wrinkles, thus worsening the quality of the elongated workpiece after bending. The anti-wrinkle tool is also constructed so that it can be modified to take into account wear during use. Furthermore, the anti-wrinkle tool must be completely replaced when worn due to having been subjected to a certain number of bending operations.

In order to remedy to these drawbacks, US 2008/0110223 describes a machine for bending an elongated workpiece without wrinkling. The machine comprises a roller-shaped die provided with a circumferential groove, and a vice adapted to hold an end of the elongated workpiece to be bent. The die is rotatable around a rotation axis, bearing, centrally and coaxially in its groove profile, a plate-like element oscillating on bearings with respect to the die around the rotation axis thereof. To receive this oscillating plate-like element, the die is made in two parts. The oscillating plate-like element has a circumferential profile shaped to match the contour of the elongated workpiece to be bent. US 2008/0110223 states that, thanks to this oscillating plate-like element, a reduction of the non-uniformity and of the air gaps is obtained in those circumferential regions of the elongated workpiece to be bent which are at higher risk. The structure constituted by the anti-wrinkle tool and the oscillating plate-like element is exposed to a minimum wear due to friction and therefore has a prolonged service life. The oscillating plate-like element is able to guide the elongated workpiece during the bending operation and to reduce to a minimum the stretching stresses of the tubular wall of the elongated workpiece.

Therefore, the oscillating plate-like element can be considered as a single piece anti-wrinkle tool. To be coupled to the bending die, the structure of the bending die is in two parts with consequent manufacturing disadvantages.

JP 2017 094374 A describes a unit of two-piece pipe bending die and anti-wrinkle tool in several parts that partially surround a die bushing. The die bushing joins the two pieces of the pipe bending die by an axial element to provide an axis of rotation. US 2016/175909 A1 describes a unit of two-piece pipe bending die and anti-wrinkle tool in several parts, of which only a first part is inserted inside the pipe bending die that is split laterally to allow this insertion. At least a second part of the anti-wrinkle tool is removably connected to the first part to allow a replacement of the second part when it is worn.

JP 2017 087220 A discloses a unit of laterally split pipe bending die and anti-wrinkle tool in several parts, of which only a first part is inserted inside a split die and is retained there by a bushing and an axial shaft element. At least a second part of the anti-wrinkle tool is removably connected to the first part of the anti-wrinkle tool to allow a replacement of the second part when it is worn.

All the units of bending die and anti-wrinkle tool of the above cited prior art require that the die either be partially split transversely or be made in two parts to allow the anti-wrinkle tool to be mounted. This requires a bushing that is held by a die shaft and surrounded by one or more parts of the anti-wrinkle tool. Furthermore, the dies described in the aforementioned documents imply, for mounting the anti-wrinkle tool in the split die, a disassembly of the die shaft and the bushing.

Furthermore, the anti-wrinkle tool is not configured symmetrically so as to be mounted on the bending die in bending an elongated workpiece in the right direction and, after disassembled and inverted, in bending in the left direction the elongated workpiece.

SUMMARY OF THE INVENTION

The present invention aims to overcome the aforementioned drawbacks.

A main object of the present invention is to allow a bend without the formation of wrinkles of an elongated workpiece, with a bending die having a structure made in one piece and without diametral splits even if only partial.

Another object of the invention is to provide an anti-wrinkle tool which can be mounted on a die without disassembling the die shaft.

Yet another object of the invention is to provide a die with an anti-wrinkle tool which allows a bending of a piece both to the right and to the left direction.

To achieve the aforementioned purposes, the present invention, as defined in claim 1 attached to the present description, provides a machine for bending an elongated piece without wrinkling comprising a bending die that has a roller-shaped structure provided with a central hole and a groove profile, the bending die, rotatable about a die rotation axis, bearing centrally and coaxially in its groove profile, a plate element oscillating about the die rotation axis, and eccentrically a vice adapted to retain one end of the elongated workpiece to be bent, the plate element having a peripheral edge which continues the groove profile of the bending die, wherein the roller-shaped structure of the bending die is in a single piece, and the plate element consists of at least two pieces which are adapted to be connected to one another after surrounding the roller-shaped structure of the bending die.

The plate element has a longitudinally symmetrical shape and is adapted to be mounted in the bending die in bending in the right direction an elongated workpiece, and to be disassembled and mounted again upside down in the bending die in bending in the left direction the elongated workpiece.

The vice has a plane of symmetry for being adapted to be mounted in the bending die for bending in the right direction the elongated workpiece, and to be disassembled and mounted again in the bending die after being rotated by 180°, for bending in the left direction the elongated workpiece.

BRIEF DESCRIPTION OF DRAWINGS

Further characteristics and advantages of the invention will become most evident from the description of an embodiment of the machine for bending an elongated workpiece without wrinkling, illustrated by way of non-limiting example in the accompanying drawings in which:

FIG. 3 is a top view of the machine in FIG. 1;

FIG. 5 is a cross-section view obtained along lines A-A in FIG. 3; and

DESCRIPTION OF AN EMBODIMENT OF THE INVENTION

Figure 1:
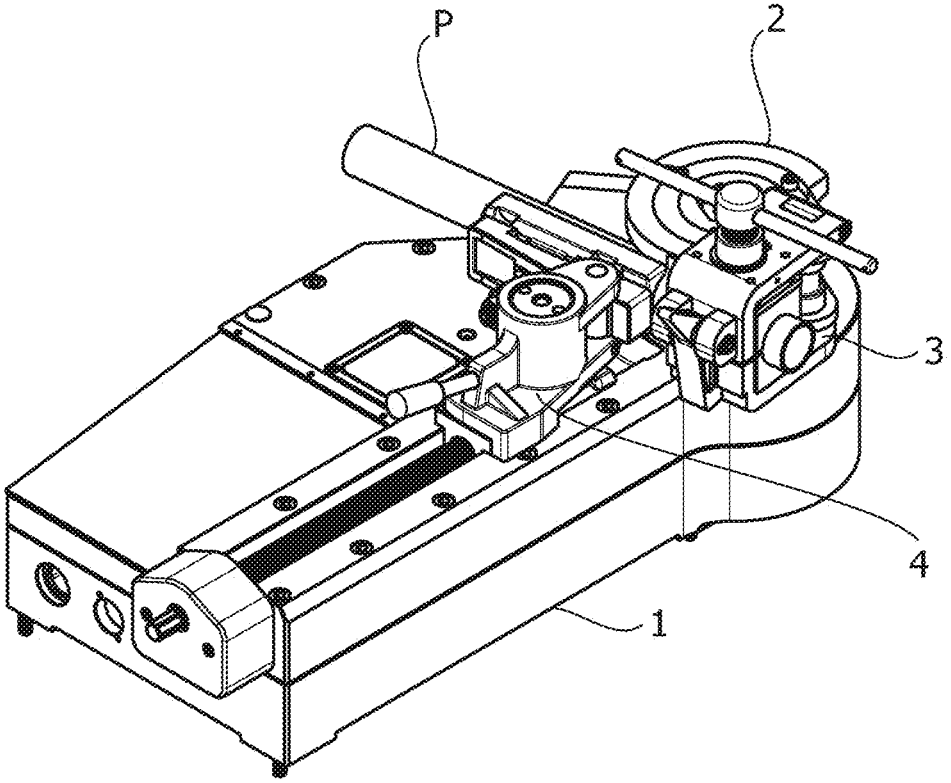
FIG. 1 is a three-quarter perspective view from above of the machine according to the invention, in beginning the bending of an elongated workpiece.
Figure 2:
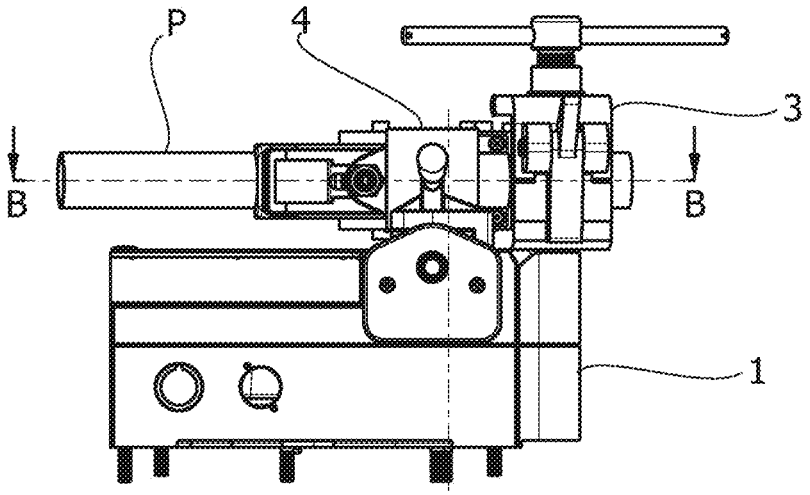
FIG. 2 is an end view opposite to the bending die of the machine in FIG. 1.

Reference is firstly made to FIGS. 1 to 3 which are a three-quarter perspective view from above of the machine according to the invention, in beginning the bending of an elongated workpiece, an end view opposite to the bending die and a top view of the machine in FIG. 1.

The machine according to the invention comprises a body 1, a bending die 2, a vice 3 designed to hold an end of an elongated workpiece P, and a counter die 4.

Figure 4:
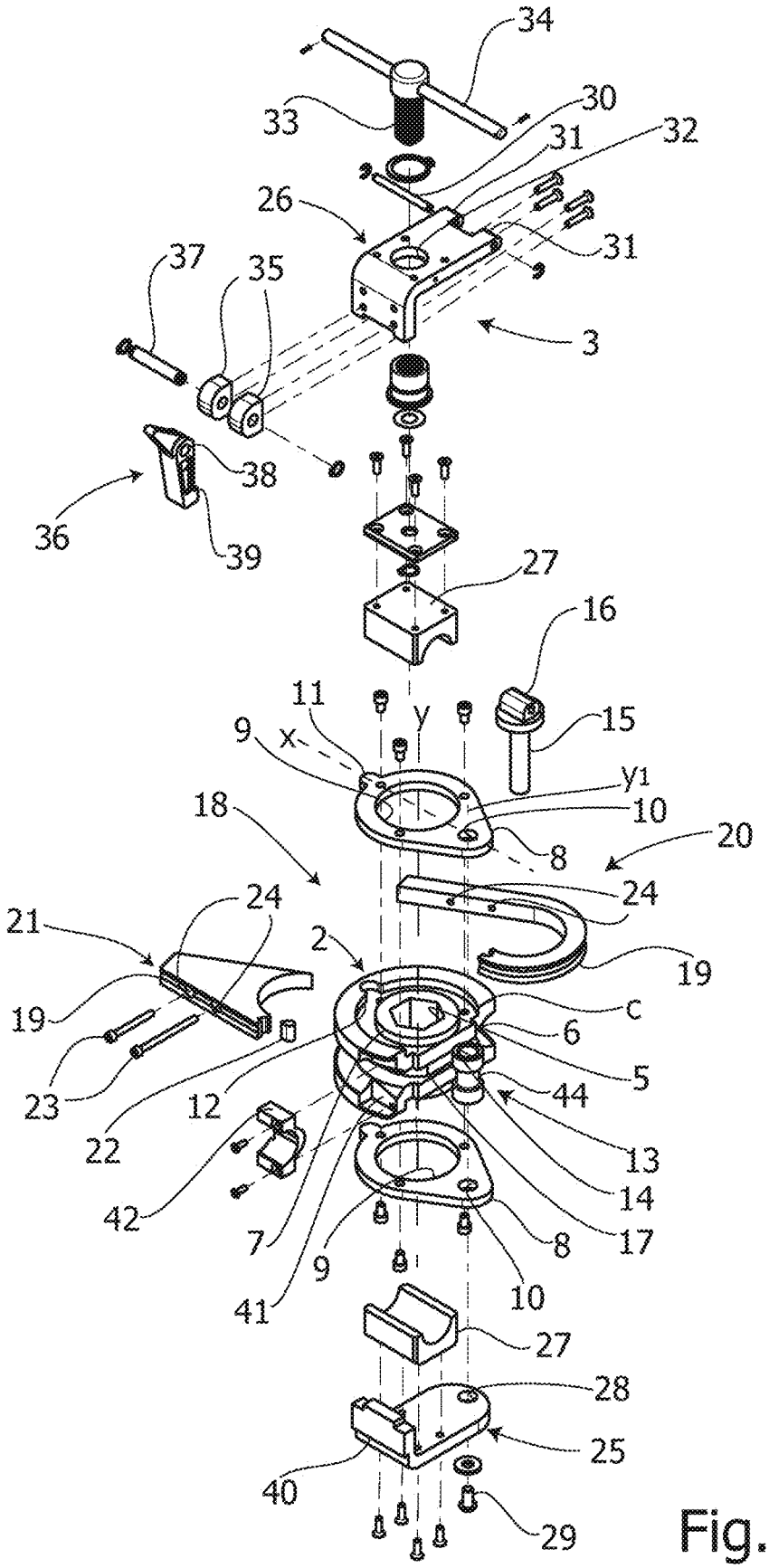
FIG. 4 is an exploded perspective view of the bending die and of the vice in FIG. 1.

As shown in detail in FIG. 4, which is an exploded perspective view of the bending die 2 and of the vice 3, the bending die 2 has a single piece roller structure, which is provided with a central hole 5 and a circumferential groove profile 6, rotatable about a die rotation axis y. The bending die 2 has, on both its sides (in the figures only the upper side is shown), a die boss 7 which surrounds the central hole 5 of the bending die 2. Furthermore, the bending die structure is lightened by a missing portion that is shaped like a circular segment, that is, the bending die 2 is cut according to a plane $\alpha$ parallel to the die rotation axis y and passing through a chord c of the circular segment. The plane $\alpha$ is indicated with its trace in FIG. 3. The circular segment has a diametral symmetry axis x, as shown in FIG. 4. Two egg-shaped support plates 8, 8 are mounted on both sides of the bending die: they have a large hole 9 coaxial to the die rotation axis y so that each support plate 8 surrounds a respective die boss 7; moreover, each support plate 8 has a small hole 10 overlying said missing portion shaped as a circular segment and being centered in an axis $y_1$ parallel to the die rotation axis y.

Each support plate 8 has an anti-rotation projection 11 in an indentation 12 of the bending die 2.

A bushing 13 is arranged between the two egg-shaped support plates 8, 8 and held therein by a fulcrum pin 15 passing through a bushing hole 14. The fulcrum pin 15 also passes through the small hole 10 of each of the two egg-shaped support plates 8, 8 and has a perforated head 16 for connection to the vice 3, as will be seen below.

The bending die 2 has, in its groove profile 6, centrally and coaxially in the profile of the same, a channel indicated with 17 in FIG. 4. The channel 17 serves to contain a plate element 18 which, thanks to the fact of being free in the channel 17, oscillates with respect to the die 2 around its rotation axis y. The plate element 18 has a peripheral edge 19 which continues the groove profile 6 of the bending die 2, adjacent to its channel 17. According to the invention, the plate element 18 is made up of pieces 20, 21, in number of two in this embodiment, adapted to be connected to each other after surrounding the bending die 2.

The two pieces 20, 21 of the plate element 18, after being arranged around the bending die 2, are joined to each other with the interposition of a grain 22 by means of screws 23 passing through holes 24 of the two pieces 20, 21. In particular, the piece 20 of the plate element 18 has the shape of a hook and is guided by the bushing 13, having a central groove 44 so as not to interfere with the rotation of the plate element 18. The piece 21 of the plate element 18 has, in plan view, a trapezoid rounded at the base and is on the opposite side to the bushing 13 with respect to the die rotation axis y.

Thanks to the fact that the plate element 18 is free to oscillate around the bending die 2, a favorable anti-wrinkle effect is obtained on the elongated workpiece P to be bent. Moreover, as already mentioned, since the plate element 18 is made in two pieces, it can be mounted on the bending die 2 to bent to the right and, disassembled and turned upside down, to bend to the left the elongated workpiece P. This is obtained thanks to the longitudinally symmetrical shape of the plate element 18 and to the fact that the vice 3 has a plane of symmetry passing through the axis of the fulcrum pin 15 and for the axis of a clamping screw 33, as shown in detail in the FIG. 3. Since the axis of the fulcrum pin 15 is located on the median plane passing through the axis of the bending die 2 and perpendicular to the trace of the plane $\alpha$, the vice 3 can be mounted on the bending die 2 in a first position and in a second position, after having been rotated by 180° with respect to the first position, in order to be used both for bending in the right and left direction, as mentioned above.

According to the present invention, as shown in detail in FIG. 4, the vice 3 comprises a lower jaw 25 and an upper jaw 26, both opposite each other, in the shape of an L. The lower jaw 25 and the upper jaw 26 carry singularly pipe retaining channels indicated generally as 27. The lower jaw 25 is provided at the rear with a through hole 28 and a fastening screw 29 for fastening the fulcrum pin 15 to the lower jaw 25 of the vice 3. The upper jaw 26 is connected rear to the perforated head 16 by means of a transverse pin 30 passing through hinge elements 31 of the upper jaw 26 placed on both sides of the perforated head 16 of the fulcrum pin 15. Furthermore, the upper jaw 26 is provided with a hole 32 and a clamping screw 33 of the pipe retaining channels 27. The clamping screw 33 is equipped with a maneuvering rod 34.

Frontally, the upper jaw 26 is provided with pierced ears 35, 35 which are located on both sides of a hooking lever 36 for clamping the lower jaw 25 and the upper jaw 26. A pin 37 is retained passing through the pierced ears 35, 35 and the head 38 of the hooking lever 36. The hooking lever 36 has at its end opposite to the head 38 a hook 39, intended to engage a front recess 40 of the lower jaw 25.

A seat 41 is formed in the bending die 2 near its circular segment cut. The seat 41, which is present on both sides of the bending die 2, in order to allow the bending to the right and to the left, is configured so as to receive a concave insert 42 which is crossed by the hook-shaped piece 20 of the plate element 18. The concave insert 42 serves to prevent the elongated workpiece P from being deformed with a bump or crushing at the beginning of the bending step and to create rectilinear continuity between the vice 3 and the groove of the bending die 2 Moreover, since it is mounted symmetrically on both sides, in the respective seats 41, the concave insert 42 has the function of allowing the assembly and disassembly of the plate element 18 to allow the right and left bending, respectively.

Reference will now be made to FIG. 5 which is a section formed according to a plane with trace A-A of FIG. 3. In this figure the vice 3 is clearly shown after assembly of its components shown in exploded view in FIG. 4. The vice 3 is in a closing position with the elongated workpiece P between the pipe-retaining channels 27.

Figure 6:
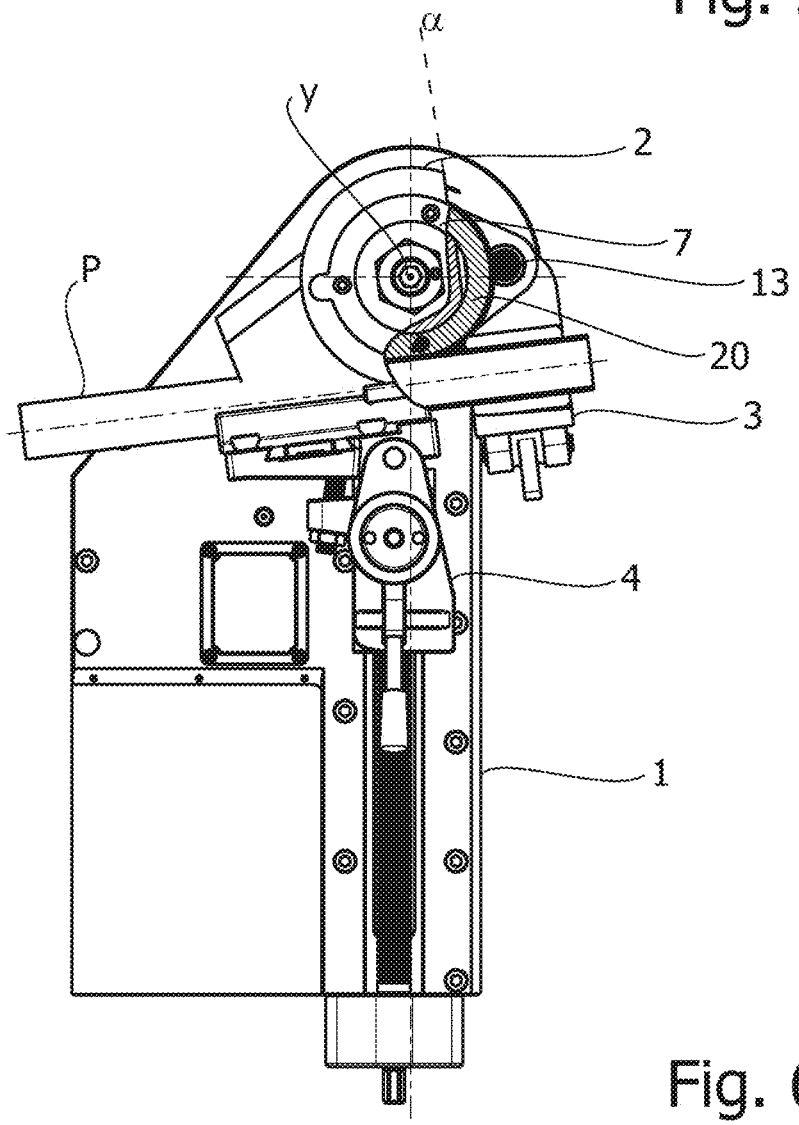
FIG. 6 is a partial cross-section view obtained along lines B-B in FIG. 2.

In FIG. 6, which is a cross-section formed according to a plane with trace B-B in FIG. 2, it is shown, in particular, that the hook-shaped piece 20 of the plate element 18 passes between the bending die 2 and the bushing 13 against the central groove 44 of the latter.

It is understood that the invention achieves the intended purposes. It allows an elongated workpiece to be bent to both right and left without wrinkle formation by a bending die having a single piece structure.

The invention claimed is:

1. A machine for bending an elongated workpiece without wrinkling, comprising:

a bending die that has a roller-shaped structure provided with a central hole and a groove profile, and is rotatable about a die rotation axis, a plate element carried by the bending die centrally and coaxially in its groove profile, so that the plate element oscillates about the die rotation axis, the plate element having a peripheral edge which continues the groove profile of the bending die, and a vice eccentrically provided in the bending die and adapted to retain one end of the elongated workpiece to be bent, wherein the roller-shaped structure of the bending die is in a single piece, and the plate element consists of at least two pieces which are adapted to be connected to one another after surrounding the roller-shaped structure of the bending die; and the plate element has a longitudinally symmetrical shape and is adapted to be mounted on the bending die in bending in the right direction an elongated workpiece, and to be disassembled and mounted again upside down on the bending die in bending in the left direction the elongated workpiece, and the vice has a plane of symmetry for being adapted to be mounted in the bending die for bending in the right direction the elongated workpiece, and to be disassembled and mounted again in the bending die after being rotated by 180°, for bending in the left direction the elongated workpiece.

2. The machine according to claim 1, wherein the bending die has, on both of its sides, a die boss which surrounds the central hole of the bending die, and is lightened by a missing portion that is shaped like a circular segment, the circular segment being cut according to a plane parallel to the die rotation axis and passing through a chord of the circular segment having a diameter symmetry axis.

3. The machine according to claim 2, wherein two egg-shaped support plates, mounted on both sides of the bending die, have a large hole coaxial with said die rotation axis so that each support plate surrounds a respective die boss, and a small hole overlying said missing portion shaped like a circular segment and centered in a rotation axis parallel to the die rotation axis, a bushing being located between the two egg-shaped support plates and held therein by means of a fulcrum pin, the fulcrum pin also passing through the small hole of each of the two egg-shaped support plates.

4. The machine according to claim 3, wherein one of the at least two pieces of the plate element is hook-shaped, and is guide by said bushing, and another of the at least two pieces of the plate element, having a plane of a trapezoid rounded at its base, is located on a side opposite to said bushing with respect to the die rotation axis.

5. The machine according to claim 4, wherein a seat is obtained symmetrically in both the sides of the bending die near the circular segment-shaped cut thereof, the seat being configured so as to receive a concave insert which is crossed by the hook-shaped piece of the plate element.

6. The machine according to claim 3, wherein the fulcrum pin has a perforated head adapted to connect the fulcrum pin to the vice by means a transverse pin.

7. The machine according to claim 6, wherein the vice comprises a lower jaw and an upper jaw, both being L-shaped and counterposed, singularly bearing facing pipe-retaining channels, the lower jaw being posteriorly provided with a through hole and a fastening screw for fastening the fulcrum pin of the vice to the lower jaw, the upper jaw being connected posteriorly to the head of the fulcrum pin by means of the transverse pin and being provided with a hole and a clamping screw passing through the hole for clamping the pipe-retaining channels.

8. The machine according to claim 7, wherein the upper jaw is provided with a hooking lever having a hook engaging a front recess of the lower jaw.

9. The machine according to claim 7, wherein the plane of symmetry of the vice symmetry passing through the axis of the fulcrum pin and for the axis of the clamping screw, and the axis of the fulcrum pin is located on a median plane passing through the die rotation axis and perpendicular to said plane.

* * * * *